US005228977A

United States Patent [19]

Moran et al.

[11] Patent Number: 5,228,977

[45] Date of Patent: Jul. 20, 1993

[54] METHOD OF PRODUCING ASPHALT HAVING AN INCREASED PENETRATION AND PENETRATION INDEX

[75] Inventors: Lyle E. Moran, Sarnia; William J. Murphy, Brights Grove, both of Canada

[73] Assignee: Exxon Research & Engineering Company, Florham Park, N.J.

[21] Appl. No.: 793,875

[22] Filed: Nov. 18, 1991

[51] Int. Cl.[5] ..... C10C 3/02

[52] U.S. Cl. ..... 208/44; 208/4

[58] Field of Search ..... 208/44, 4; 423/447.7

[56] References Cited

U.S. PATENT DOCUMENTS 2,179,208 11/1939 Burk et al. ..... 208/4

3,130,144 4/1964 Bostwick et al. ..... 208/44

4,338,137 7/1982 Goodrich ..... 208/44

*Primary Examiner*—Theodore Morris

*Assistant Examiner*—P. L. Hailey

*Attorney, Agent, or Firm*—John W. Ditsler; James H. Takemoto

[57] ABSTRACT

This invention relates to a method for producing asphalt that has improved low temperature properties. More specifically, the penetration and Penetration Index of an asphalt can be increased if the asphalt is heat soaked in the presence of a dehydrogenation agent at a temperature above the temperature at which oxidation of the asphalt occurs and below the temperature at which coking is initiated. Polyvinyl chloride and a chlorinated wax are preferred dehydrogenation agents.

8 Claims, No Drawings

METHOD OF PRODUCING ASPHALT HAVING AN INCREASED PENETRATION AND PENETRATION INDEX

BACKGROUND OF THE INVENTION

1. Field of the Invention

This invention concerns a method for improving the low temperature properties of an asphalt by heat soaking the asphalt in the presence of a dehydrogenation agent.

2. Discussion of Related Art

Asphalt is a bituminous material resulting from the distillation of crude oil. Typically, asphalt is derived from the bottoms of a vacuum distillation tower and has an atmospheric boiling point of at least 380° C. Because it is hydrophobic and has good adhesiveness and weatherability, asphalt has been used widely as a binder in paving materials and as a coating for roofing shingles.

Shingle coating and some saturants require that the vacuum distilled asphalt be air blown at 200°-300° C. to polymerize the asphalt by the known process of oxidative dehydrogenation in which hydrogen is removed as water vapor in the off-gas. This improves the creep (or flow) resistance and weatherability of the asphalt as well as reduces its sensitivity to temperature changes. Oxidative dehydrogenation can also be effected by using sulfur or sulfuroxygen gases such as sulfur dioxide, chlorine gas, etc., which result in hydrogen sulfide and hydrochloride off-gases instead of water vapor. However, the common practice is to use air blowing.

Conventional paving asphalt binders, by comparison, are not usually air-blown but are vacuum residues which are manufactured to meet certain control specifications such as flash (ASTM D 92), penetration at 25° C. (ASTM D 5), apparent viscosity at 60° C. (ASTM D 2171), and kinematic viscosity at 135° C. (ASTM D 2170). In addition to the control specifications, a paving asphalt should also meet certain performance specifications such as ductility (ASTM D 113), solubility in trichloroethylene (ASTM D 2042), and thin film oven aging (ASTM D 1754).

General refinery practice is to distill crudes deep enough to maximize the recovery of preferred distillate molecules and minimize asphalt pitch production. However, this approach has the disadvantage of producing pitch that is too hard for commercial asphalt application.

This invention overcomes this problem by providing a method to maintain pitch reduction as the refinery objective while concurrently giving the refiner the capability of producing the full range of softer asphalt grades with the added benefit of producing asphalts with improved low temperature performance as measured by an increased penetration and Penetration Index.

SUMMARY OF THE INVENTION

This invention relates to a method of producing an asphalt having improved low temperature properties. More specifically, the viscosity and Penetration Index of an asphalt can be improved by reacting the asphalt with a dehydrogenation (or hydrogen abstraction) agent at a temperature above the temperature at which oxidation of the asphalt occurs and below the temperature at which coking is initiated. This results in an asphalt product that has a softer consistency (as measured by increased penetration and decreased viscosity at 25° C.) and a higher Penetration Index than the asphalt feedstock or comparable asphalt products produced exclusively by vacuum distillation. Polyvinyl chloride or a chlorinated wax are preferred dehydrogenation agents.

DETAILED DESCRIPTION OF THE INVENTION

The Penetration Index is used to characterize the temperature susceptibility of asphalts at low temperatures. Asphalts with low Penetration Indexes (less than 0.0) are more susceptible to temperature. Pavements made with these asphalts show greater transverse cracking caused by thermally induced stresses. Asphalts with higher Penetration Indexes (0.0 or greater) are progressively less susceptible to temperature. Pavements made with these asphalts experience less transverse cracking and consequently have better low temperature performance.

The Penetration Index was first defined by J. PH. Pfeiffer and P. M. van Doormal, J. Institute of Petroleum Technologists, 22, p. 414, 1936 and is reviewed in the textbook, "The Properties of Asphaltic Bitumen", edited by J. PH. Pfeiffer, Elsevier Publishing Company, 1950, pp. 166-170. The Penetration Index is calculated using the formula:

$$PI=(20-500B)/(50B+1)$$

where $$B=d\log 10(Pen)/dT$$

The value of B is determined from a plot of log10 Penetration (as measured by the penetration of a 100 g weight in 5 seconds) versus temperature.

When an asphalt is heat soaked or air-blown at a temperature of from about 200° to about 300° C., alone or in the presence of a dehydrogenation agent (e.g. ferric chloride), the asphalt is polymerized to a harder product (i.e. one having a lower penetration and higher viscosity at 25° C.) and the product has a higher Penetration Index. If the asphalt feedstock is heat soaked alone at a temperature between about 300° and about 400° C., the product has a softer consistency than the feedstock and a low Penetration Index. A harder product having a low Penetration Index is expected to be produced under air-blowing conditions without catalyst at a temperature between about 300° and about 400° C.

By comparison, and quite unexpectedly, if the asphalt is heat soaked in the presence of a dehydrogenation agent at a temperature above the temperature at which oxidation of the asphalt occurs and below the temperature at which coking is initiated, there results a softer asphalt product (as measured by increased penetration at 25° C.) with a higher Penetration Index. By "onset of oxidation" is meant the temperature at which the penetration of the asphalt decreases, and the viscosity and Penetration Index increase. By "onset of coking" is meant the temperature at which solids (i.e. thermal coke) start to form. Typically, this "window" will correspond to a temperature between about 300° and about 400° C. Preferably, the temperature should be maintained between about 310° and about 390° C., most preferably between about 330° and about 370° C. However, the precise reaction temperature used will vary with the asphaltene content of the asphalt, with asphalts having a lower asphaltene content (e.g. less than 5 wt. %) generally requiring a lower temperature and higher asphaltene content asphalts (e.g. 8 wt. % or more) generally requiring a higher temperature.

Thus, by using this invention, the refiner can maximize the production of more valuable lower boiling hydrocarbons and minimize pitch production by distilling the crude to a low penetration asphalt, then processing this asphalt to produce a softer, specification grade asphalt which has improved low temperature properties.

The asphalt used in this invention may be obtained from a variety of sources including straight-run vacuum residue; mixtures of vacuum residue with diluents such as vacuum tower wash oil, paraffin distillate, aromatic and naphthenic oils, and mixtures thereof; oxidized vacuum residues or oxidized mixtures of vacuum residues and diluent oils; and the like. Other asphaltic materials such as coal tar pitch, rock asphalt, and naturally occurring asphalt may also be used. Typically, the asphalt will have an atmospheric boiling point of at least 380° C., more typically of at least 440° C.

Although essentially any dehydrogenation agent can be used, preferred agents will be selected from the group consisting of air, aluminum trichloride, boric acid, boron trifluoride, chlorinated wax, chlorinated polymers (e.g. chloroform, chlorinated polyethylene), cupric chloride, elemental sulfur, ferric chloride, hydrochloric acid, nitric acid, oxygen, phosphoric acid, phosphorous pentoxide, polyvinyl chloride, sulfuric acid, mixtures thereof, and the like. Particularly preferred dehydrogenation agents are a chlorinated wax, ferric chloride, phosphoric acid, or polyvinyl chloride, with a chlorinated wax and polyvinyl chloride being most preferred.

The amount of dehydrogenation agent reacted with the asphalt is not critical and will vary depending on the specific dehydrogenation agent and type of asphalt used. In broadest terms, the dehydrogenation agent need only be present in an amount sufficient to effect an increase in both penetration and Penetration Index of the asphalt. Typically, however, the amount of dehydrogenation agent used will range between about 0.05 and about 10 wt. %, preferably between about 0.1 and about 8 wt. %, and most preferably between about 1 and about 6 wt. %, based on weight of the asphalt. Greater amounts within these ranges will normally be required with higher asphaltene content asphalts.

Similarly, the period of time the asphalt and dehydrogenation agent are reacted will vary with the temperature employed. Only a period of time sufficient to increase the penetration and Penetration Index is required. Typically, however, reaction times will vary from about 0.1 to about 24 hours (although longer times could be used), but preferably reaction times will range from about 0.5 to about 10 hours, with shorter times being required at higher reaction temperatures and longer times at lower temperatures.

The asphalt may be mixed or blended with the dehydrogenation agent in any number of ways that can readily be selected by one skilled in the art. Suitable means include external mixers, roll mills, internal mixers, Banbury mixers, screw extruders, augers, and the like. Normally, the mixing or blending will be at ambient pressure. The dehydrogenation agent may be added to the asphalt before or during heat soaking.

The asphalt product formed according to this invention may be employed in essentially any application requiring softer asphalt-based products having enhanced low temperature properties. Examples of such applications include adhesives, coatings, fabricated products, road and roofing applications, sealants, sound and vibration dampening products, water proofing membranes and the like. However, the final product is particularly well suited for use as a paving binder, particularly a binder in the load bearing course as well as the top or surface course of hot mix pavement structures.

This invention will be further understood by reference to the following examples, which include a preferred embodiment of this invention, but are not intended to restrict the scope of the claims appended hereto. In the examples, the penetration at 25° C. was determined using ASTM D 5, the kinematic viscosity at 135° C. using ASTM D 2170, and the Penetration Index using the formula described previously.

EXAMPLE 1

Treating Asphalt From High Asphaltene Crude

Several samples of an 80/100 penetration grade asphalt from a crude containing from about 12 to about 13 wt. % asphaltenes were heat soaked (HS) in an autoclave under various reaction conditions. The properties of the resulting products are shown in Table 1.

TABLE 1

| Sample No. | Temperature °C. | Time min | Heat Soaking | Dehydrogenation Agent, wt. % | Pen @ 25° C. | Viscosity @ 135° C. | PI | Comments |
|---|---|---|---|---|---|---|---|---|
| 1 | Ambient | 0 | 0 | No | 80 | 408 | −1.4 | Feedstock |
| 2 | 340 | 90 | Yes | No | 187 | 246 | −1.1 | HS Alone |
| 3 | 300 | 90 | Yes | No | 90 | 385 | −1.0 | HS Alone |
| 4 | 340 | 90 | Yes | 2% PVC | 221 | 201 | +1.0 | Invention |
| 5 | 300 | 90 | Yes | 2% PVC | 63 | 523 | +0.9 | Transition |
| 6 | 260 | 7 hours | Yes | 2% PVC | 48 | 788 | +0.8 | Oxidation |
| 7 | 260 | 216 hours | Yes | 2% $H_3PO_4$(1) | 85 | 3299 | +1.3 | Transition (2) |

(1) 85 wt. % in water.
(2) Transition from oxidation to this invention due to longer reaction time at lower temperature.

EXAMPLE 2

Treating Asphalt From A Low Asphaltene Crude

Several samples of a 116 penetration grade asphalt from a crude containing from about 1 to about 3 wt. % asphaltenes were heat soaked (HS) in an autoclave under various reaction conditions. The properties of the resulting products are shown in Table 2.

TABLE 2

| Sample No. | Temperature °C. | Time min | Heat Soaking | Dehydrogenation Agent, wt. % | Pen @ 25° C. | Viscosity @ 135° C. | PI | Comments |
|---|---|---|---|---|---|---|---|---|
| 8 | Ambient | 0 | No | No | 116 | 210 | −2.5 | Feedstock |

TABLE 2-continued

| Sample No. | Temperature °C. | Time min | Heat Soaking | Dehydrogenation Agent, wt. % | Pen @ 25° C. | Viscosity @ 135° C. | PI | Comments |
|---|---|---|---|---|---|---|---|---|
| 9 | 360 | 180 | Yes | No | 226 | 149 | −2.4 | HS Alone |
| 10 | 340 | 90 | Yes | No | 138 | 204 | −2.7 | HS Alone |
| 11 | 300 | 90 | Yes | No | 117 | 217 | −2.6 | HS Alone |
| 12 | 380 | 90 | Yes | 2% PVC | >410 | 74 | (1) | Coking |
| 13 | 360 | 90 | Yes | 2% PVC | 403 | 116 | −1.7 | Invention |
| 14 | 340 | 90 | Yes | 2% PVC | 112 | 257 | −1.3 | Transition |
| 15 | 300 | 90 | Yes | 2% PVC | 70 | 290 | −1.7 | Oxidation |
| 16 | 280 | 90 | Yes | 2% PVC | 62 | 306 | −0.6 | Oxidation |

(1) Greater than 410 penetration is not measurable such that PI cannot be calculated. Also, 12.2 wt. % solids formed, rendering the product unsuitable as asphalt.

The data in Tables 1 and 2 show that the products made by this invention (heat soaking in the presence of a dehydrogenation agent at a temperature above the onset of oxidation and below the onset of coking) are softer and have a higher Penetration Index than the products obtained by simple distillation (Samples 1 and 8) and by heat soaking alone (Samples 2–3 and 9–11). The data also confirm that a softer product having a higher PI is obtained only over a narrow temperature range, i.e., a temperature above the onset of oxidation (as evidenced by a decrease in penetration, and an increase in viscosity and PI) and below the initiation of coking (as evidence by the start of solids formation).

What is claimed is:

1. A method of producing a softer asphalt product with improved low temperature properties from an asphalt feed which comprises measuring the penetration and Penetration Index of the asphalt feed and heat soaking the asphalt feed in the presence of a dehydrogenation agent, wherein from about 0.05 to about 10 wt. % of the hydrogenation agent, based on weight of the asphalt, is present during heat soaking, at a temperature ranging between about 300° and about 400° C., said temperature being sufficient to increase the penetration and Penetration Index over that of the asphalt feed provided that the temperature should not exceed the temperature at which onset of coking occurs.

2. The method of claim 1 wherein the dehydrogenation agent is selected from the group consisting of air, aluminum trichloride, boric acid, boron trifluoride, chlorinated polymers, chlorinated wax, chloroform, cupric chloride, elemental sulfur, ferric chloride, hydrochloric acid, nitric acid, phosphoric acid, oxygen, phosphorous pentoxide, polyvinyl chloride, sulfuric acid, and mixtures thereof.

3. The method of claim 2 where the dehydrogenation agent is selected from the group consisting of a chlorinated wax, ferric chloride, phosphoric acid, polyvinyl chloride.

4. The method of claim 3 wherein the dehydrogenation agent is polyvinyl chloride or a chlorinated wax.

5. The method of claim 4 wherein the temperature ranges from about 330° to about 370° C.

6. The method of claim 4 wherein from about 1 to about 6 wt. % of the dehydrogenation agent is present during heat soaking.

7. The method of claim 6 wherein the dehydrogenation agent is polyvinyl chloride.

8. The method of claim 6 wherein the dehydrogenation agent is chlorinated wax.

* * * * *